US007207812B1

(12) United States Patent
Wong

(10) Patent No.: US 7,207,812 B1
(45) Date of Patent: Apr. 24, 2007

(54) LOCKING MECHANISM

(75) Inventor: Foo Luen Wong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/163,577

(22) Filed: Oct. 24, 2005

(51) Int. Cl.
*H01R 13/44* (2006.01)

(52) U.S. Cl. ..... 439/136; 439/911

(58) Field of Classification Search ..... 439/136, 439/911
See application file for complete search history.

(56) References Cited

U.S. PATENT DOCUMENTS 5,050,211 A * 9/1991 Dortu et al. ..... 379/438
5,949,652 A * 9/1999 McAnally et al. ..... 361/726
6,902,421 B1 * 6/2005 Huang ..... 439/372
2005/0041354 A1 2/2005 Pruett et al.

* cited by examiner

*Primary Examiner*—Thanh-Tam Le

(57) ABSTRACT

A locking mechanism for securing a cover to a housing is provided. The housing includes an electrical socket. The mechanism includes a locking plate, a casing for enclosing the locking plate, and an engaging member. The locking plate has a securing member and a protruding member. The engaging member extends from the cover. When the locking plate is in a first position, the securing member is engaged with the engaging member to secure the cover to the housing. When the locking plate is in a second position, the securing member is disengaged from the engaging member and the protruding member is extended into the electrical socket.

20 Claims, 6 Drawing Sheets

LOCKING MECHANISM

FIELD OF THE INVENTION

The invention relates generally to locking mechanisms, and more particularly, to a locking mechanism for securing a cover to a housing.

BACKGROUND OF THE INVENTION

Most electrical equipments have an electrical socket for receiving an electrical plug. The electrical plug supplies power to a power supply unit in such an electrical equipment, which in turn supplies power to the electrical components in the equipment. The equipment usually has a housing to house the circuitries of the power supply unit, the electrical connections between power supply unit to the components and the electrical connections among the components.

When there is a fault in the functioning of the electrical equipment, a cover of the housing is typically removed to check whether any of the electrical components are faulty. The checking for faulty components usually includes probing the electrical connections of the components and the circuitries. The circuitries and the electrical connections, especially those at the power supply unit, may carry high voltages from the electrical plug. If the power supply is not turned off, a technician or user may receive an electrical shock while checking for faulty components or when removing the cover of the equipment. Such electrical shocks are hazardous, and may cause burns or even death to the technician or user.

A safety interlock switch is commonly included in the electrical equipment to prevent against such electrical hazards. The safety interlock switch is a mechanical switch which cuts off the power supply from the electrical plug. The switch may be attached to the cover of the equipment, so that the switch is automatically actuated when the cover is removed. However, any accidental activation of the switch while checking for faulty components may make the circuitries and the electrical connections "live".

In some examples, the power supply unit is enclosed in a protective cage since the circuitries handling the high voltages are usually in the power supply unit. However for some electrical equipment, the electrical connections outside the power supply unit also carry high voltages. In addition, the protective cage may also cause an increase in airflow resistance, and hence, affect the cooling effectiveness of the components in the equipment.

SUMMARY OF THE INVENTION

In an embodiment, a locking mechanism for securing a cover to a housing is provided. The housing includes an electrical socket. The mechanism includes a locking plate, a casing for enclosing the locking plate, and an engaging member. The locking plate has a securing member and a protruding member. The engaging member extends from the cover. When the locking plate is in a first position, the securing member is engaged with the engaging member to secure the cover to the housing. When the locking plate is in a second position, the securing member is disengaged from the engaging member and the protruding member is extended into the electrical socket.

BRIEF DESCRIPTION OF THE DRAWINGS

The embodiments of the invention will be better understood in view of the following drawings and the detailed description.

DETAILED DESCRIPTION OF THE INVENTION

A locking mechanism is provided in an embodiment to secure a cover to a housing of an electrical equipment. When the locking mechanism is in a locked state, the cover is secured to the housing. In other words, the cover could not be removed from the housing. An electrical plug can be inserted into an electrical socket of the housing in this locked state. In order to remove the cover from the housing, the locking mechanism has to be in an unlocked state. To switch the locking mechanism from the locked position to the unlocked state, the electrical plug has to be removed from the electrical socket of the equipment. The locking mechanism includes a locking plate, a casing and an engaging member.

Figure 1:
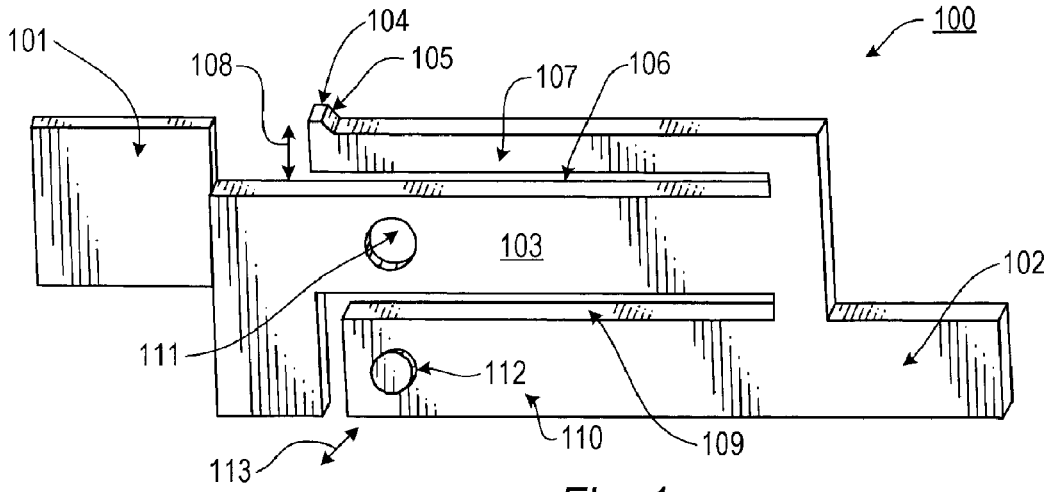
FIG. 1 shows an example of a locking plate of a locking mechanism according to an embodiment.

FIG. 1 shows an example of the locking plate 100 of the locking mechanism according to an embodiment. The locking plate 100 includes a securing member 101 and a protruding member 102 extending from a main body 103. Both the securing member 101 and the protruding member 102 are in a form of a plate, and extend from a first end and second end of the main body 103, respectively. It is possible for the securing member 101 and the protruding member 102 to be in any forms or shapes in other embodiments. The thickness of the securing member 101 and the protruding member 102 are smaller than the thickness of the main body 103.

The locking plate 100 includes a stopper 104 which is a raised portion along an edge of the main body 103. The stopper 104 is tapered at one side 105. A first slit 106 is formed in the main body 103 below the stopper 104. As a result, a first arm portion 107 is formed, with the stopper 104 at the end of the first arm portion 107. The first arm portion 107, and hence the stopper 104, is able to deflect slightly in the vertical direction 108. A second slit 109 is formed below the first slit 106. As a result, a second arm portion 110 is formed below the second slit 109. The thickness of the second arm portion 110 is smaller than the thickness of the main body 103. Therefore, the second arm portion 110 is able to deflect slightly in the horizontal direction 113.

The locking plates includes a hole 111 on the main body 103. In this example, the hole 111 is a blind hole, that is, it is not open at the other side of the main body 103. The hole 111 may be open, that is a through-hole, in another embodiment. The main body 103 includes a boss 112 on the second arm portion 110. The boss 112 provides a détente feature to the locking plate 100, as will be described later.

Figure 2:
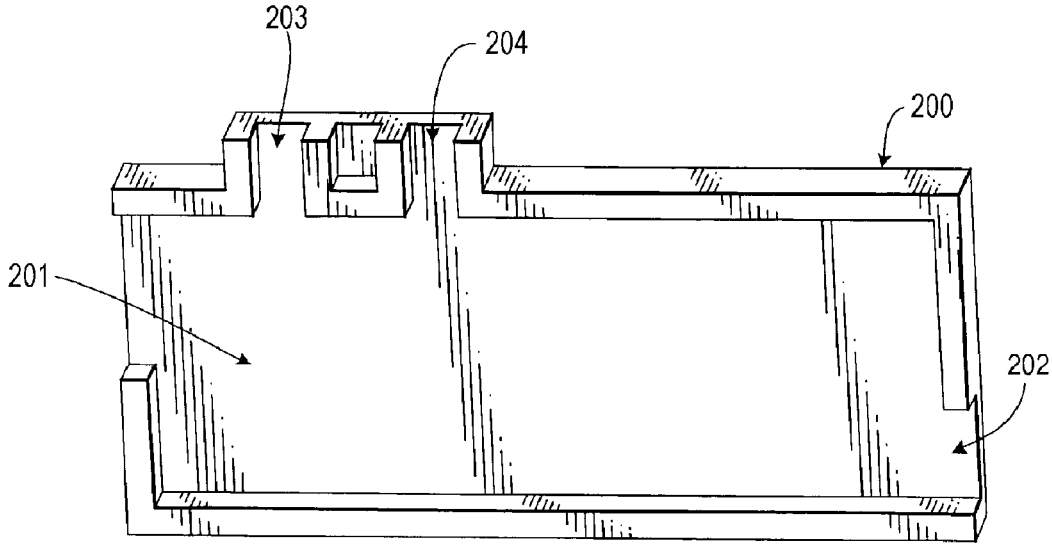
FIG. 2 shows an example of a casing of the locking mechanism according to an embodiment.

FIG. 2 shows an example of a casing 200 according to an embodiment. The casing 200 is adapted to enclose the locking plate 100. The casing 200 has a first opening 201 and a second opening 202. When the locking plate 100 is arranged in the casing 200, the securing member 101 is extendable through the first opening 201, and the protruding member 102 is extendable through the second opening 202. The casing 200 further includes a first channel 203 and a second channel 204. The first and second channels 203, 204 are adapted to receive the stopper 104 of the locking plate 100.

Figure 3:
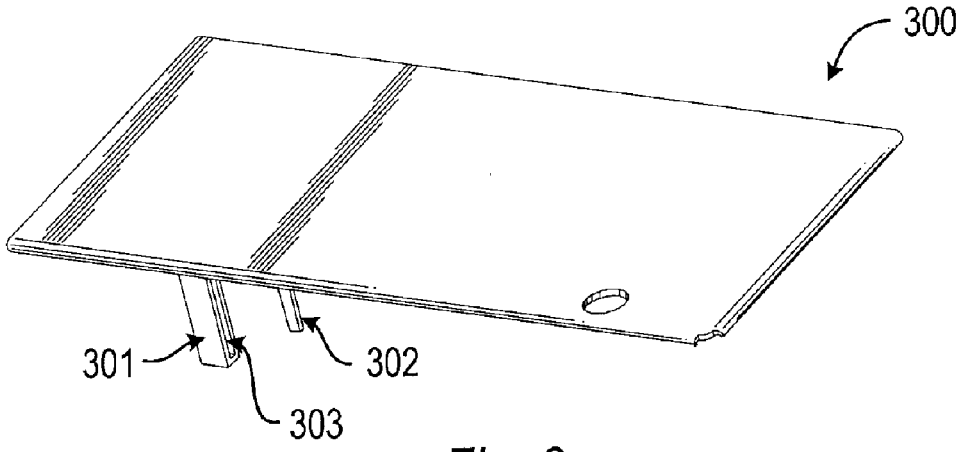
FIG. 3 shows an example of a cover to a housing of an electrical equipment according to an embodiment.

FIG. 3 shows an example of the cover 300 to the housing of the electrical equipment according to an embodiment. The cover 300 includes an engaging member 301 and a de-latching member 302. Both the engaging member 301 and the de-latching member 302 extend vertically downwards from the cover 300. The engaging member 301 has a slot 303. The slot 303 of the engaging member 301 is adapted to receive the securing member 101 when the cover 300 is assembled onto the housing. The de-latching member 302 is adapted to fit into the second channel 204 of the casing 200 when the cover 300 is assembled onto the housing.

Figure 4:
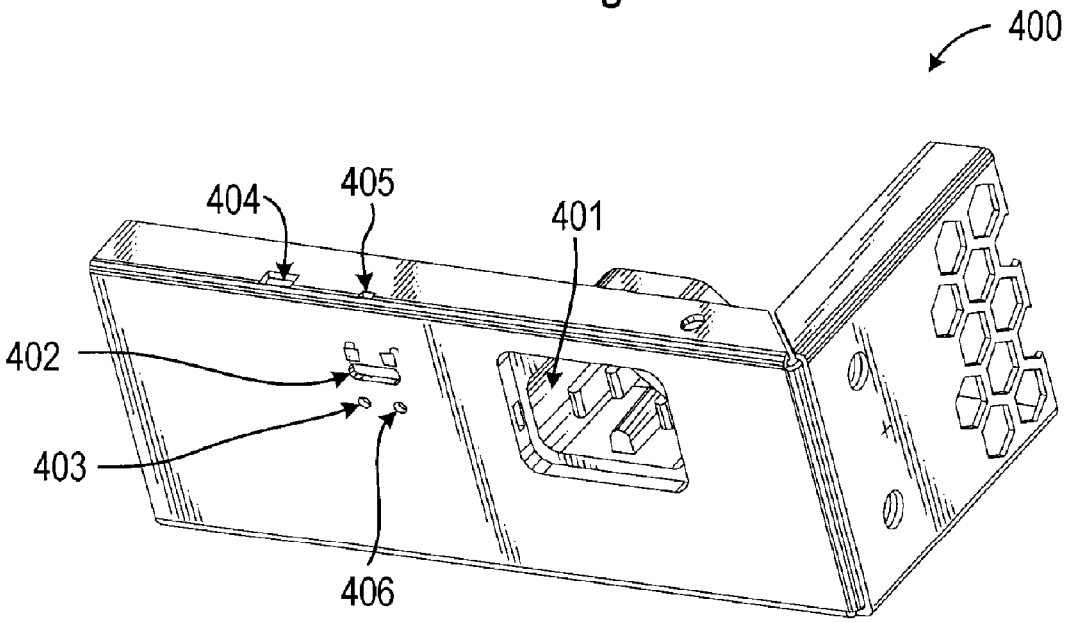
FIG. 4 shows an example of the housing of the electrical equipment according to an embodiment.

FIG. 4 shows an example of the housing 400 of the electrical equipment according to an embodiment. The housing 400 includes the electrical socket 401, an opening 402 and two boss holes 403, 406. The opening 402 allows a user to access the hole 111 of the locking plate 100 when the locking mechanism is attached to the housing 400. The boss holes 403, 406 are adapted to receive the boss 112 of the locking plate 100. The housing 400 also includes another two openings 404, 405 for receiving the engaging member 301 and the de-latching member 302 when the cover 300 is assembled onto the housing 400.

Figure 5:
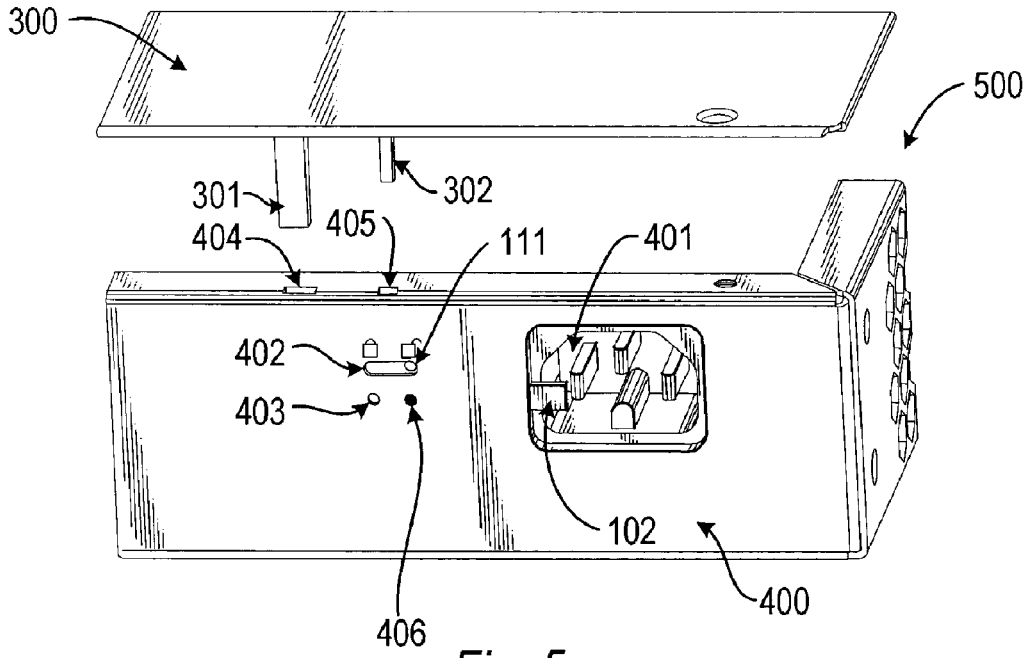
FIG. 5 shows an example of the locking mechanism according to an embodiment.

The locking mechanism is formed by arranging the locking plate 100 into the casing 200, and attaching the open end of the casing 200 to the inside surface of the housing 400. An example of the locking mechanism 500 is shown in FIG. 5. The casing 200 is attached to the inside surface of the housing 400 in a manner such that the hole 111 of the locking plate 100 is accessible through the opening 402 of the housing 400. The housing includes two markings above the opening 402. A first marking shows a locked symbol, and a second marking shows an unlocked symbol. These two symbols correspond to the locked state and the unlocked state of the locking mechanism. As shown in FIG. 5, the locking mechanism 500 is in the unlocked state. In this unlocked state, the hole 111 is shown through the opening 402 and directly below the unlocked symbol. The boss 112 of the locking plate 100 is also received in the boss opening 406 directly below the unlocked symbol. Accordingly, the combination of the boss 112 and the boss opening 406 acts as a détente feature for the locking plate 100. A détente is a catch or lever that locks the movement of one part of a mechanism. The protruding member 102 of the locking plate 100 extends into the electrical socket 401 in the unlocked state.

Figure 6:
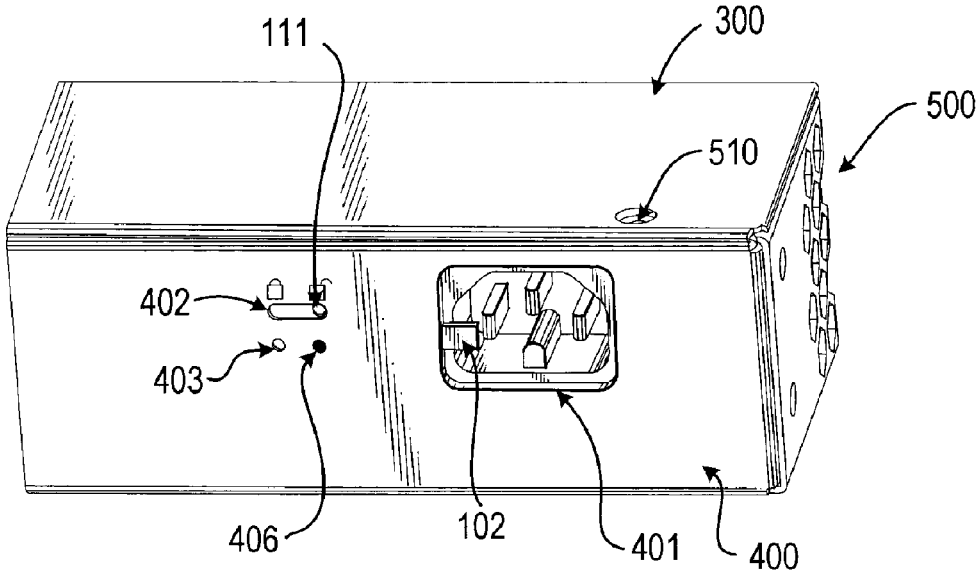
FIG. 6 shows an example of the locking mechanism with the cover assembled onto the housing according to an embodiment.
Figure 7:
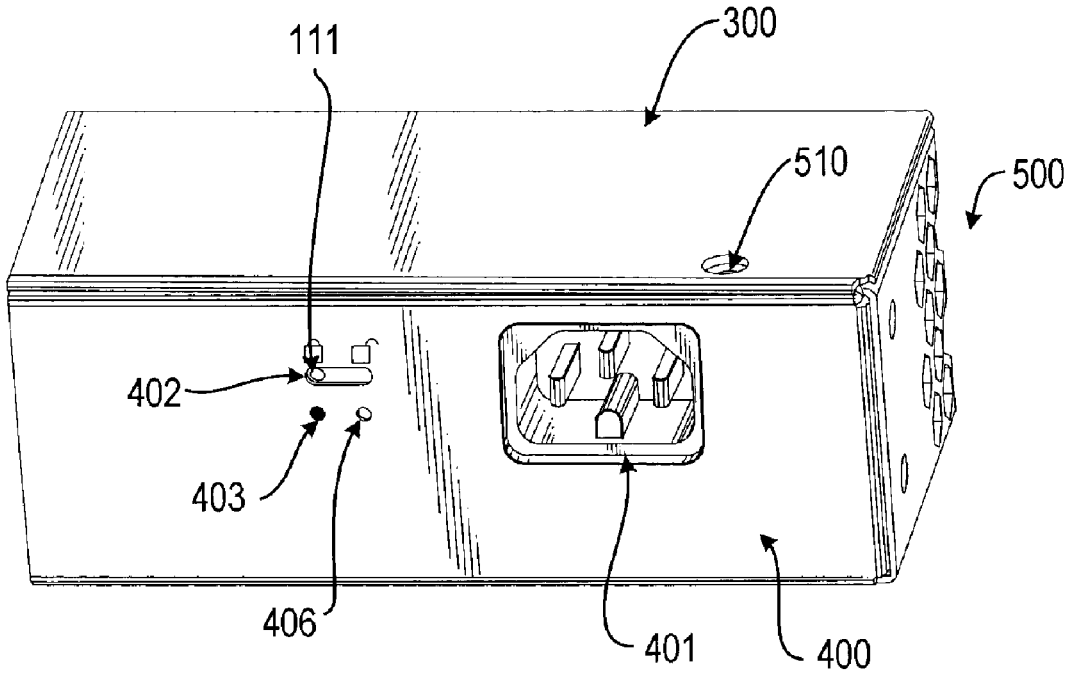
FIG. 7 shows an example of the locking mechanism in a locked state according to an embodiment.

The engaging member 301 and the de-latching member 302 are inserted through the respective corresponding openings 404, 405 of the housing 400 when the cover 300 is assembled onto the housing 400. FIG. 6 shows the locking mechanism 500 with the cover 300 assembled onto the housing 400. The cover 300 may include a screw hole 510 for inserting a screw (not shown) to attach the cover 300 to the housing 400. The cover 300 is subsequently secured to the housing 400 by switching the locking mechanism 500 to the locked state. The locking mechanism 500 is switched to the locked state by engaging the hole 111 of the locking plate 100 and sliding it along the opening 402 of the housing 400 until the hole 111 is directly below the locked symbol as shown in FIG. 7. At this locked state, the boss 112 of the locking plate 100 is received in the boss opening 403 directly below the locked symbol. The protruding member 102 of the locking plate 100 is retracted from the electrical socket 401. Accordingly, an electrical plug can be inserted into the electrical socket 401.

It should be noted that the hole 111 of the locking plate 100 may be engaged using an external tool which can be inserted into the hole 111 to slide the locking plate 100. Examples of such an external tool include Allen key, screwdriver and pencil. It should also be noted that, in other embodiments, the hole 111 may be replaced with another engaging means, such as a knob, for engaging and sliding the locking plate 100.

Figure 8:
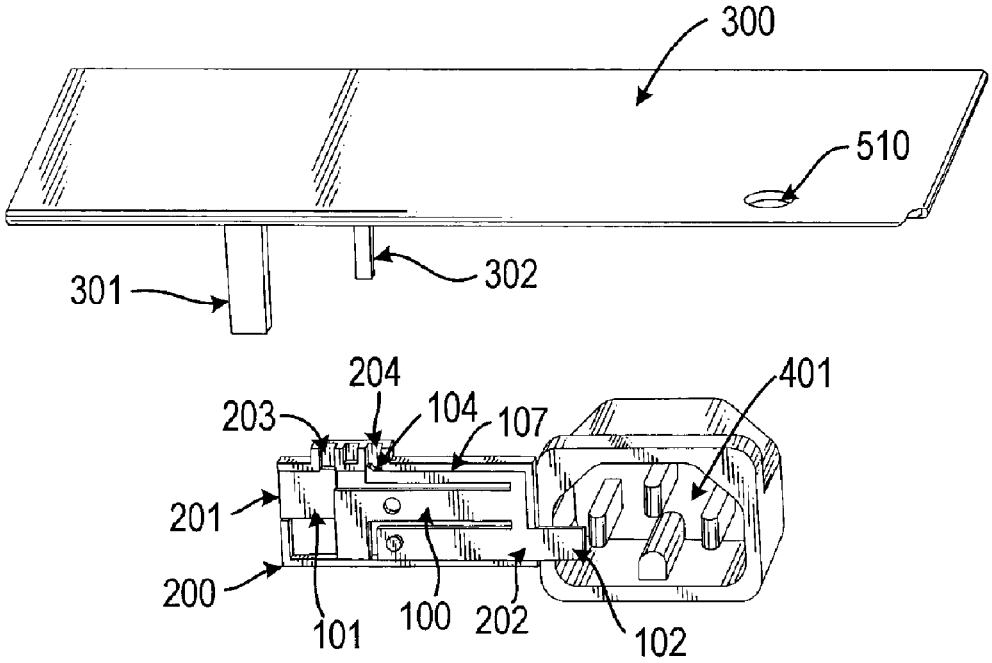
FIG. 8 shows the locking mechanism of FIG. 5 with the housing removed to illustrate the locking plate and the casing according to an embodiment.

The arrangement of the locking plate 100 inside the casing 200 shall be described with reference to FIGS. 8–10. FIG. 8 shows the locking mechanism 500 of FIG. 5, with the housing 400 removed to illustrate the locking plate 100 and the casing 200. In the unlocked state, the protruding member 102 of the locking plate 100 extends through the second opening 202 of the casing 200 into the electrical socket 401. The securing member 101 aligns with the edge of the first opening 201. The stopper 104 is received in the second channel 204 of the casing 200. In this unlocked state, the locking plate 100 is in an unlocked position. The stopper 104 in the second channel 204 prevents or stops the locking plate 100 from moving to a locked position, which corresponds to the locked state of the locking mechanism 500.

Figure 9:
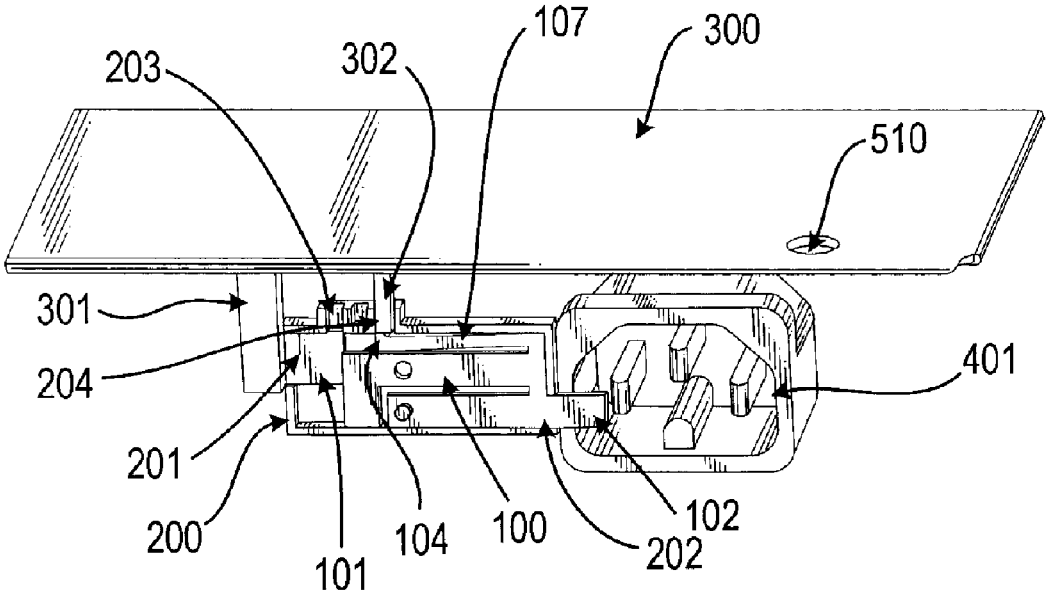
FIG. 9 shows the locking mechanism of FIG. 6 with the housing removed to illustrate the locking plate and the casing according to an embodiment.

FIG. 9 shows the arrangement of the cover 300, the casing 200 and the locking plate 100 when the cover 300 is assembled onto the housing (not shown). The engaging member 301 of the cover 300 is adjacent to the first opening 201 of the casing 200. The de-latching member 302 is inserted into the second channel 204 and pushes the stopper 104 of the locking plate 100. As a result, the first arm portion 107 of the locking plate 100 is deflected downwards, causing the stopper 104 to be pushed out of the second channel 204. Accordingly, the locking plate 100 can be moved from the unlocked position to the locked position since the stopper 104 does not prevents the locking plate 100 from being moved to the locked position.

Figure 10:
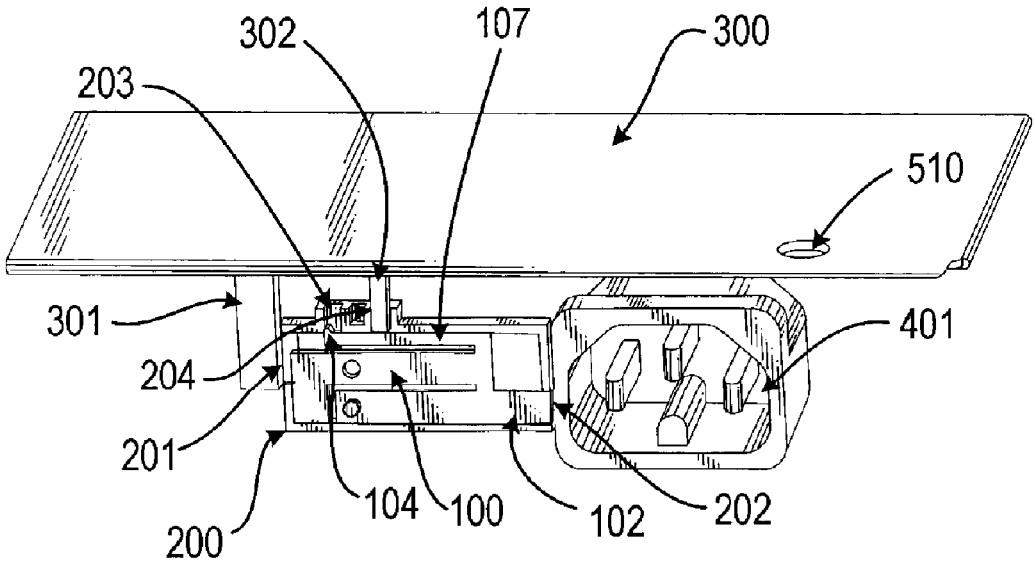
FIG. 10 shows the locking mechanism of FIG. 7 with the housing removed to illustrate the locking plate and the casing according to an embodiment.

FIG. 10 shows the arrangement of the cover 300, the casing 200 and the locking plate 100 when the locking mechanism 500 is in the locked state. When the locking plate 100 is moved to the locked position, the securing member 101 protrudes from the first opening 201 and is received into the slot 303 of the engaging member 301. The protruding member 102 of the locking plate 100 is retracted from the electrical socket 401, and is aligned with the edge of the second opening 202 of the casing 200. The stopper 104 of the locking plate 100 is received in the first channel 203 of the casing 200.

At this locked position, the engaging member 301 of the cover 300 is engaged by the securing member 101 of the locking plate 100. Accordingly, the cover 300 is secured to the housing (not shown in FIG. 10) by the locking plate 100. It should be noted that since the stopper 104 is tapered at one side 105, the locking plate 100 can be moved from the locked position to the unlocked position without the need of a de-latching member. When the locking plate 100 is moved from the locked position to the unlocked position, the tapered end 105 of the stopper 104 causes the first arm portion 107 of the locking plate to deflect downwards. Accordingly, the stopper 104 slides out of the first channel 203 and is received into the second channel 204 when the locking plate 100 is moved to the unlocked position.

The locking mechanism described according to above embodiments allows an electrical plug to be inserted in the electrical socket 401 only when the cover 300 is secured to the housing 400. To remove the cover 300 from the housing 400, the locking mechanism 500 has to be switched to the unlocked state. As already seen in FIG. 6, the protruding member 102 of the locking plate 100 protrudes or extends into the electrical socket 401 when the locking mechanism 500 is in the unlock state. Therefore, when the electrical plug is in the electrical socket 401, the locking mechanism 500 is prevented from being switched to the unlocked state. In order to switch the locking mechanism 500 to the unlocked state, the electrical plug has to be first removed from the electrical socket 401. Accordingly, the locking mechanism 500 according to the embodiment ensures that the electrical plug is removed when the cover 300 of the housing 400 is removed. Therefore, a technician or user would not get an electrical shock when removing the cover 300 or when probing the circuitries enclosed by the housing 400 since the electrical plug would have already been removed.

With the cover 300 removed, it is also not possible to insert the electrical plug into the electrical socket 401, as the path to the electrical socket 401 is obstructed by the protruding member 102. It is also not possible to switch the locking mechanism 500 to the locked state due to the stopper 104 in the second channel 204 of the casing 200. In order to insert the electrical plug into the electrical socket 401, the cover 300 has to be assembled onto the housing 400. Therefore, the locking mechanism 500 according to the above embodiments provides a simple yet effective way of preventing electrical shocks to the technician or user checking on the circuitries of the electrical equipments.

Figure 11:
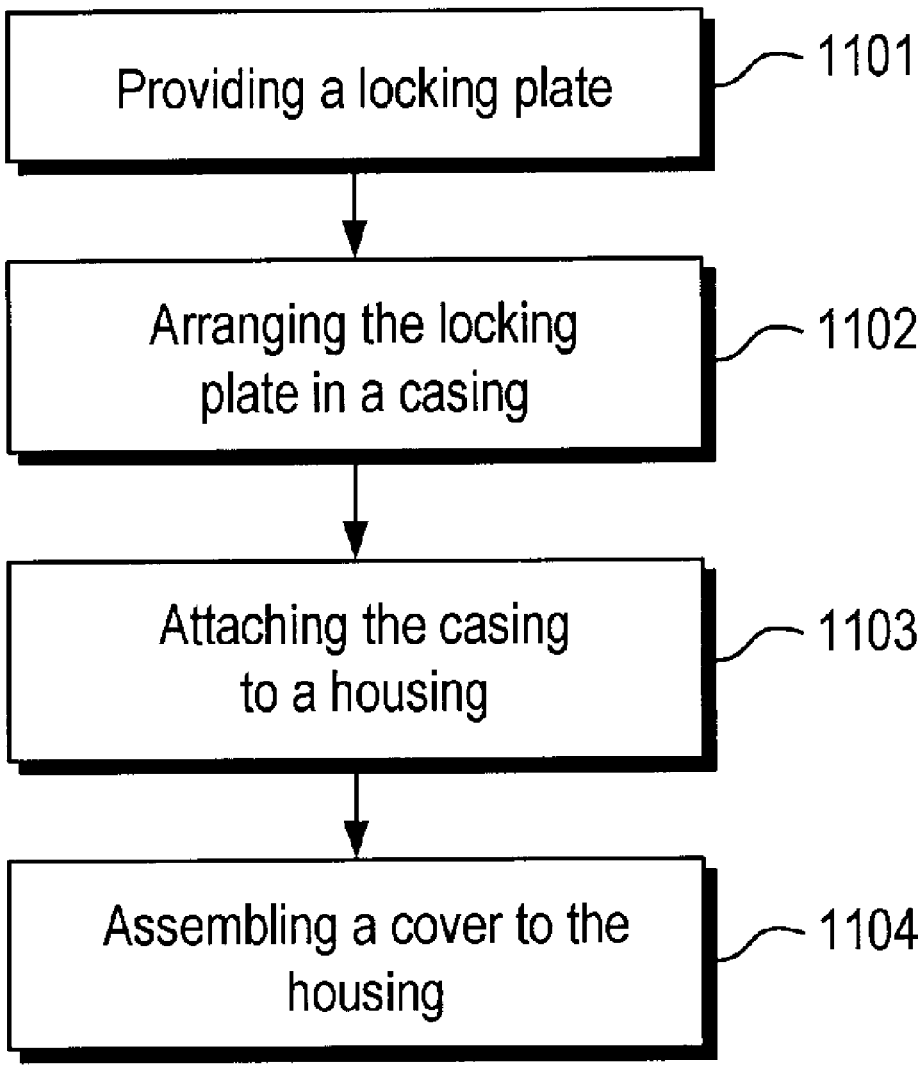
FIG. 11 shows a flow-chart of a process for manufacturing the locking mechanism according to an embodiment.

FIG. 11 shows a flow-chart of a process for manufacturing the locking mechanism 500 according to an embodiment. Step 1101 includes providing the locking plate 100 having the securing member 101 and the protruding member 102. Step 1102 includes arranging the locking plate 100 into the casing 200. The locking plate 100 is arranged in the casing 200 such that it is movable between two positions within the casing 200. Step 1103 includes attaching the casing 200 to the housing 400. Step 1104 includes assembling the cover 300 with the engaging member 301 to the housing 400. The casing 200 is attached to the housing 400 such that when the locking plate 100 is in one position, the securing member 101 extends through the first opening 201 of the casing 200 and engages the engaging member 301 of the cover 300. When the locking plate 100 is in another position, the securing member 101 disengages the engaging member 301 and the protruding member 102 extends through the second opening 202 of the casing into the electrical socket 401.

Although the present invention has been described in accordance with the embodiments as shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A locking mechanism for securing a cover to a housing having an electrical socket, comprising:

a locking plate having a securing member and a protruding member;

a casing for enclosing the locking plate, the casing comprises a first opening through which the securing member extends to engage an engaging member and a second opening through which the protruding member extends into the electrical socket; and the engaging member extending from the cover, wherein when the locking plate is in a first position, the securing member engages the engaging member, thereby securing the cover to the housing, and when the locking plate is in a second position, the securing member disengages from the engaging member and the protruding member extends into the electrical socket.

2. The locking mechanism of claim 1, wherein the casing is attached to the housing.

3. The locking mechanism of claim 1, wherein the securing member is in the form of a plate extending from the locking plate.

4. The locking mechanism of claim 3, wherein the engaging member is in the form of a block which is generally perpendicular to the cover, and wherein the engaging member has a slot defined therein for receiving the securing member when the locking plate is in the first position, thereby engaging the securing member with the engaging member.

5. The locking mechanism of claim 1, wherein the locking plate further comprises:

a stopper which stops the locking plate from moving from the second position to the first position, wherein the stopper is a raised portion along an edge of the locking plate; and a slit at a portion below the stopper, such that the stopper is able to deflect in a generally vertical position.

6. The locking mechanism of claim 5, wherein the casing comprises a first channel and a second channel, and wherein the stopper is received in the first channel when the locking plate is in the first position, and the stopper is received in the second channel when the locking plate is in the second position.

7. The locking mechanism of claim 6, wherein the stopper is tapered at one side to allow the stopper to slide out of the first channel into the second channel when the locking plate is moved from the first position to the second position.

8. The locking mechanism of claim 7 further comprising a de-latching member extending from the cover, wherein when the cover is assembled onto the housing, the de-latching member extends into the second channel of the casing and pushes the stopper out of the second channel, such that the locking plate is movable from the second position to the first position.

9. The locking mechanism of claim 1, wherein the locking plate further comprises a hole for engaging a tool to switch the locking plate between the first position and the second position, and wherein the housing comprises a corresponding opening for accessing the hole on the locking plate.

10. The locking mechanism of claim 9, wherein the locking plate further comprises a boss, and the housing further comprises two boss holes, wherein when the locking plate is in one of the first and second positions, the boss is fitted into one of the boss holes to provide a Détente feature for the locking plate.

11. A power supply unit comprising:

a housing for power supply circuitries, the housing includes an electrical socket for receiving an electrical plug for providing power;

a cover including an engaging member extending therefrom;

a locking plate having a securing member and a protruding member; and a casing attached to the housing for enclosing the locking plate, the casing comprises a first opening through which the securing member extends to engage the engaging member, and a second opening through which the protruding member extends into the electrical socket, wherein when the locking plate is in a first position, the securing member engages the engaging member to secure the cover to the housing, and when the locking plate is in a second position, the securing member disengages from the engaging member, and the protruding member extends into the electrical socket to prevent an electrical plug from being inserted into the electrical socket.

12. The power supply unit of claim 11, wherein the securing member is in the form of a plate extending from the locking plate.

13. The power supply unit of claim 12, wherein the engaging member is in the form of a block which is generally perpendicular to the cover, and wherein the engaging member has a slot defined therein for receiving the securing member when the locking plate is in the first position, thereby engaging the securing member with the engaging member.

14. The power supply unit of claim 11, wherein the locking plate further comprises:

a stopper which stops the locking plate from moving from the second position to the first position, wherein the stopper is a raised portion along an edge of the locking plate; and a slit at a portion below the stopper, such that the stopper is able to deflect in a generally vertical position.

15. The power supply unit of claim 14, wherein the casing comprises a first channel and a second channel, and wherein the stopper is received in the first channel when the locking plate is in the first position, and the stopper is received in the second channel when the locking plate is in the second position.

16. The power supply unit of claim 15, wherein the stopper is tapered at one side to allow the stopper to slide out of the first channel into the second channel when the locking plate is moved from the first position to the second position.

17. The power supply unit of claim 16 further comprising a de-latching member extending from the cover, wherein when the cover is assembled onto the housing, the de-latching member extends into the second channel of the casing and pushes the stopper out of the second channel, such that the locking plate is movable from the second position to the first position.

18. The power supply unit of claim 11, wherein the locking plate further comprises a hole for engaging a tool to switch the locking plate between the first position and the second position, and wherein the housing comprises a corresponding opening for accessing the hole on the locking plate.

19. The power supply unit of claim 18, wherein the locking plate further comprises a boss, and the housing further comprises two boss holes, wherein when the locking plate is in one of the first and second positions, the boss is fitted into one of the boss holes to provide a Détente feature for the locking plate.

20. A process for manufacturing a locking mechanism for securing a cover to a housing, wherein the housing includes an electrical socket, the process comprising:

providing a locking plate, wherein the locking plate includes a securing member and a protruding member;

arranging the locking plate into a casing having a first opening and a second opening, wherein the locking plate is movable between a first position and a second position within the casing;

attaching the casing to the housing; and assembling the cover to the housing, wherein the cover includes an engaging member extending therefrom, wherein the casing is attached to the housing such that when the locking plate is in the first position, the securing member extends through the first opening to engage the engaging member, and when the locking plate is in the second position, the securing member disengages from the engaging member and the protruding member extends through the second opening into the electrical socket.

* * * * *